US008363857B2

(12) United States Patent
Zhou et al.

(10) Patent No.: US 8,363,857 B2
(45) Date of Patent: Jan. 29, 2013

(54) PORTABLE ELECTRONIC DEVICE

(75) Inventors: Xiang-Ping Zhou, Shenzhen (CN); Gui-Rong Zhou, Shenzhen (CN); Lin-Kun Ding, Shenzhen (CN); Shih-Fang Wong, Taipei Hsien (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 1439 days.

(21) Appl. No.: 11/960,713

(22) Filed: Dec. 20, 2007

(65) Prior Publication Data

US 2008/0267415 A1 Oct. 30, 2008

(30) Foreign Application Priority Data

Apr. 26, 2007 (CN) ..... 2007 1 0200515

(51) Int. Cl.
*H04R 3/00* (2006.01)

(52) U.S. Cl. ..... 381/122; 381/104; 381/107; 381/123

(58) Field of Classification Search ..... 381/122
See application file for complete search history.

(56) References Cited

U.S. PATENT DOCUMENTS

| | | | | | |
|---|---|---|---|---|---|
| 3,410,958 | A * | 11/1968 | Cohen | 381/57 |
| 3,919,911 | A * | 11/1975 | Nakata et al. | 84/711 |
| 4,438,528 | A * | 3/1984 | Itagaki | 455/182.2 |
| 4,737,134 | A | 4/1988 | Rumsey | |
| 4,843,627 | A * | 6/1989 | Stebbins | 381/110 |
| 5,382,791 | A * | 1/1995 | Leff et al. | 250/221 |
| 5,481,615 | A | 1/1996 | Eatwell et al. | |
| 5,581,626 | A * | 12/1996 | Palmer | 381/103 |
| 5,684,294 | A * | 11/1997 | Kouhi | 250/214 AL |
| 6,046,670 | A | 4/2000 | Martin | |
| 6,215,676 | B1 * | 4/2001 | Pierson | 363/59 |
| 2005/0082463 | A1 * | 4/2005 | Koyama et al. | 250/214 R |
| 2005/0105718 | A1 * | 5/2005 | Hansen et al. | 379/390.01 |
| 2006/0238241 | A1 * | 10/2006 | Pearce et al. | 330/10 |
| 2008/0232610 | A1 * | 9/2008 | Kung | 381/94.1 |

* cited by examiner

*Primary Examiner* — Robert J Hoffberg
*Assistant Examiner* — Igwe U Anya
(74) *Attorney, Agent, or Firm* — Altis Law Group, Inc.

(57) ABSTRACT

A portable electronic device includes a player, a speaker, a control circuit, a switch circuit, and a current limiter. The player is for outputting analog audio signals. The speaker is for transforming the analog audio signals into sound. The control circuit is for generating a first control signal when ambient light intensity is lower than a predetermined value. The switch circuit is for turning on and transmitting the analog audio signals to the speaker when receiving the first control signal. The current limiter is for transmitting the analog audio signals to the speaker when the switch circuit turns off, and for limiting a current flowing through the speaker.

20 Claims, 3 Drawing Sheets

PORTABLE ELECTRONIC DEVICE

BACKGROUND

1. Field of the Invention

The present invention relates to electronic devices, and particularly to a portable electronic device with an automatic adjusting ring.

2. Description of Related Art

Nowadays, many portable electronic devices such as mobile phones, personal digital assistants (PDAs), electronic clocks, etc are widely used. These devices are equipped with an audible notification to alert/signal an incoming call, a short message, or an alarm clock going off, etc. Commonly, the audible alarm may be a ring and a volume of the ring can be adjusted manually according to the surroundings. However, it is inconvenient to adjust the volume of the ring manually. Specifically, when the portable electronic device is placed in a handbag, a drawer, or a pocket, the sound of the ring is weakened by walls of the enclosed space, thus people may miss the above-said affairs.

Therefore an improved portable electronic device is needed to address the aforementioned deficiency and inadequacies.

SUMMARY

A portable electronic device includes a player, a speaker, a control circuit, a switch circuit, and a current limiter. The player is for outputting analog audio signals. The speaker is for transforming the analog audio signals into sound. The control circuit is for generating a first control signal when ambient light intensity is lower than a predetermined value. The switch circuit is for turning on and transmitting the analog audio signals to the speaker when receiving the first control signal. The current limiter is for transmitting the analog audio signals to the speaker when the switch circuit turns off, and for limiting a current flowing through the speaker.

Other advantages and novel features of the present invention will become more apparent from the following detailed description of preferred embodiment when taken in conjunction with the accompanying drawings, in which:

DETAILED DESCRIPTION OF THE EMBODIMENTS

Reference will now be made to the drawings to describe a preferred embodiment of the present portable electronic device.

Figure 1:
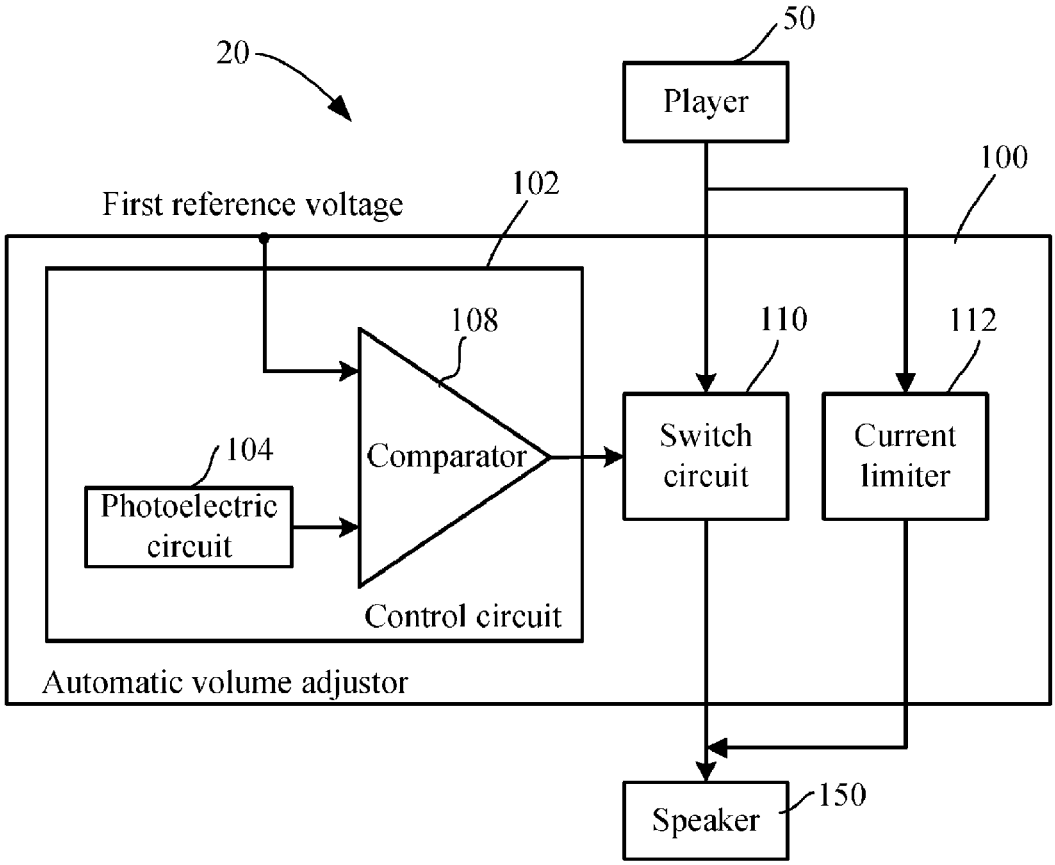
FIG. 1 is a block diagram showing a portable electronic device in accordance with an exemplary embodiment.

Referring to FIG. 1, a portable electronic device 20 includes a player 50, an automatic volume adjustor 100, and a speaker 150. The player 50 is used for decoding an encoded (in other words, compressed) audio file and outputting analog audio signals. The speaker 150 is configured for transforming the analog audio signals into sound to alert/signal an incoming call, a short message, an alarm clock going off, etc. The automatic volume adjustor 100, connected between the player 50 and the speaker 150, is configured for transmitting the analog audio signals to the speaker 150 and adjusting a current of the analog audio signals flowing through the speaker 150 according to ambient light intensity, thus adjusting a volume of the sound outputted by the speaker 150.

As we know, when the portable electronic device 20 is placed in an enclosed space such as a handbag, a drawer, or a pocket, the ring of the portable electronic device 20 is dampened. Thus, the sound of the ring is weakened by walls of the enclosed space. Generally, a light intensity inside the enclosed space is always low. If the ambient light intensity is lower than a predetermined value, the portable electronic device 20 will detect that it is in an enclosed space, and the automatic volume adjustor 100 will transmit a larger current to the speaker 150. Thus, an actual volume of the sound outputted by the speaker 150 when in an enclosed space is larger than when the portable electronic device 20 is outside the enclosed space.

The automatic volume adjustor 100 includes a control circuit 102, a switch circuit 110, and a current limiter 112. The control circuit 102 is for generating a first control signal when ambient light intensity is lower than the predetermined value, otherwise, the control circuit 102 generates a second control signal. The switch circuit 110 is configured for enabling and transmitting the analog audio signals to the speaker 150 when receiving the first control signal. When receiving the second control signal, the switch circuit 110 is disabled. The current limiter 112 is for transmitting the analog audio signals to the speaker 150 when the switch circuit 110 is disabled, and for limiting a current of the analog audio signals flowing through the speaker, thus weakening the volume of the sound the speaker 150 outputted.

The control circuit 102 includes a photoelectric circuit 104 and a comparator 108. The photoelectric circuit 104 is for generating a first control voltage according to the ambient light intensity. The first control voltage equals to a first reference voltage when the ambient light intensity at least equals to the predetermined value. The comparator 108 compares the first control voltage with the first reference voltage. In response to the comparison result, the comparator 108 generates the first control signal and the second control signal.

Figure 2:
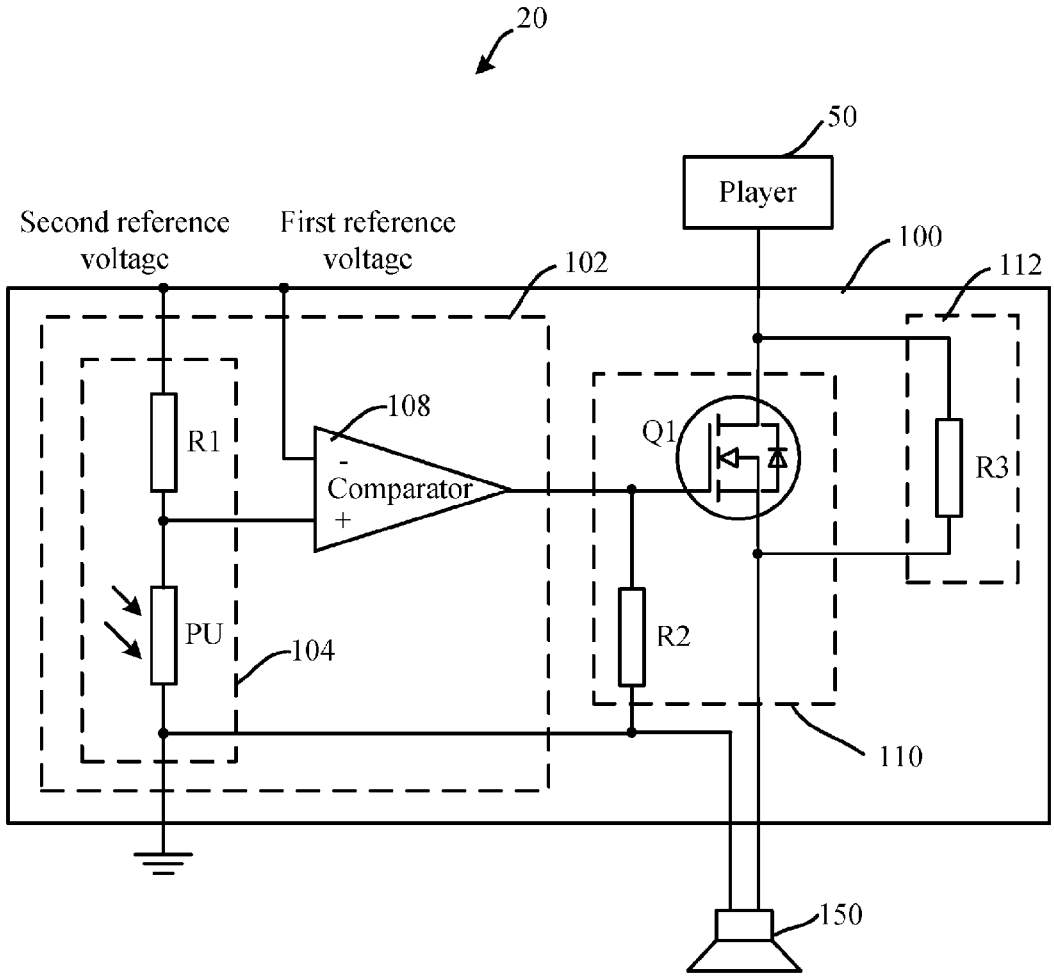
FIG. 2 is a schematic diagram showing a first structure of the portable electronic device of FIG. 1.

Referring to FIG. 2, the photoelectric circuit 104 includes a first resistor R1 and a photoconductive unit. The photoconductive unit may be a photoconductive cell, or a photodiode, etc. In the embodiment, the photoconductive unit is a photoconductive cell PU. The switch circuit 110 includes a transistor and a second resistor R2. In the embodiment, the switch circuit 110 includes an N-Channel enhancement type field effect transistor (FET) Q1 and the second resistor R2. In other embodiments, the FET Q1 can be replaced by a bipolar junction transistor (BJT). The current limiter 112 includes a third resistor R3. A second reference voltage is applied to an end of the first resistor R1. Another end of the first resistor R1 is connected to a non-inverting input terminal of the comparator 108 and an end of the photoconductive cell PU. Another end of the photoconductive cell PU is connected to ground. The first reference voltage is applied to an inverting input terminal of the comparator 108 whose output terminal is connected to a gate of the FET Q1. A drain of the FET Q1 is connected to the player 50, and a source of the FET Q1 is connected to an end of the speaker 150. The other end of the speaker 150 is connected to ground. The second resistor R2 is connected between the gate and source of the FET Q1. The third resistor R3 is connected between the drain and source of the FET Q1. There is a diode connected between the source and drain of the FET Q1 to protect the FET Q1 from inverse voltage.

The photoconductive cell PU is a light-sensitive resistor in which resistance decreases in response to an increase in light intensity when illuminated. When the ambient light intensity decreases/increases, the resistance of the photoelectric cell PU increases/decreases accordingly. Therefore, the voltage applied on the photoelectric cell PU varies according to the resistance of the photoelectric cell PU. That is, the first control voltage supplied to the non-inverting input terminal of the comparator 108 varies according to the resistance of the photoelectric cell PU. When the ambient light intensity is lower than the predetermined value, the first control voltage is higher than the first reference voltage, thus the comparator 108 outputs a high voltage (in other words, the first control signal may be 5 volts, for example) which turns on the FET Q1. Because an on-state drain-to-source resistance of the FET Q1 is very small, usually about 0.05 ohm, and a resistance of the third resistor R3 for limiting current is usually 50~200 ohm, thus, almost all current of the analog audio signals flow through the FET Q1 to the speaker 150. When the ambient light intensity is higher than or equal to the predetermined value, the first control voltage is lower than or equal to the first reference voltage source, thus the comparator 108 outputs a low voltage or 0 volt (in other words, the second control signal may be −5 to 0 volts, for example) which turns off the FET Q1. The analog audio signals must be transmitted to the speaker 150 via the third resistor R3, and the current of the analog audio signals is limited by the third resistor R3. Thus, the volume of the sound the speaker 150 outputted is higher when the FET Q1 turns on than that when the FET Q1 turns off.

Figure 3:
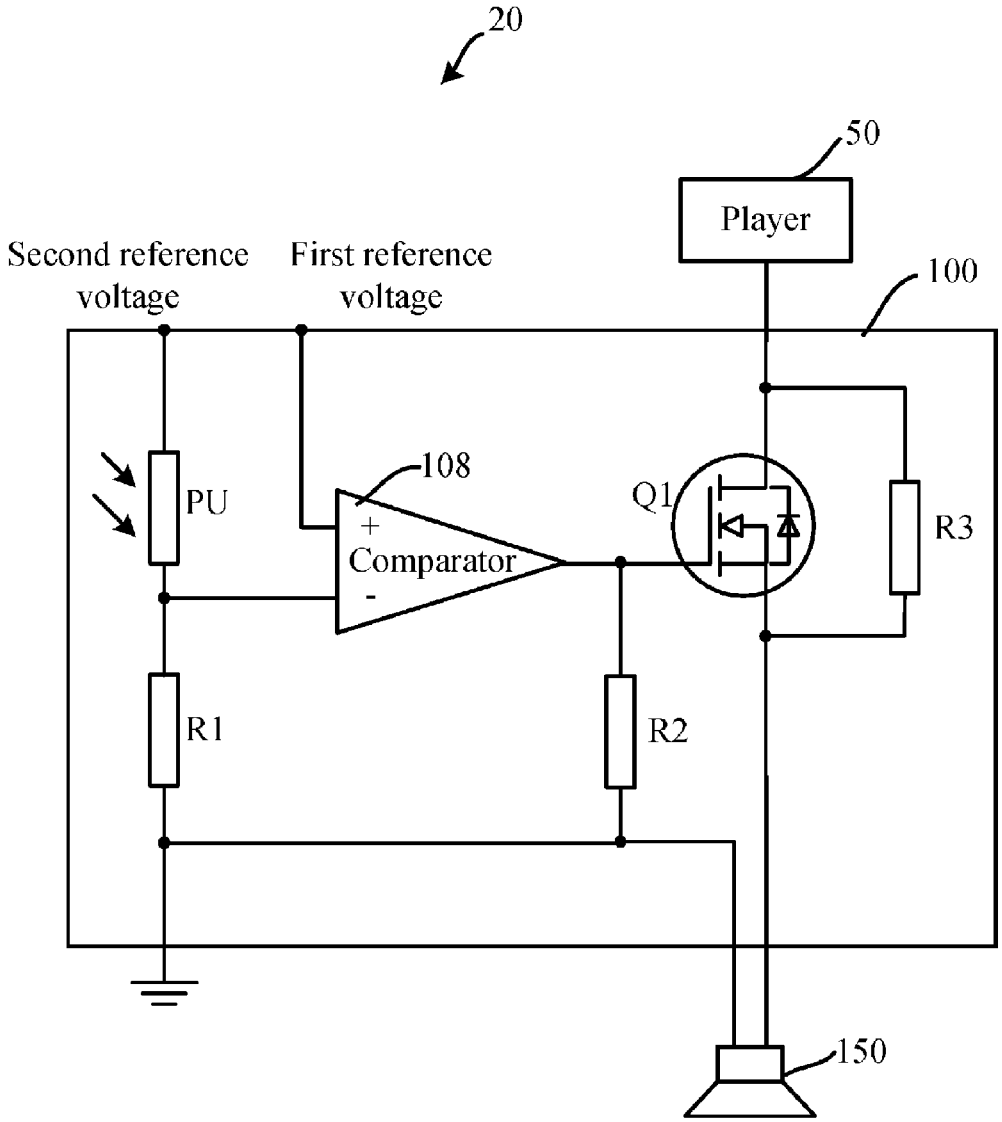
FIG. 3 is a schematic diagram showing a second structure of the portable electronic device of FIG. 1.

In another preferred embodiment, referring to FIG. 3, an end of the first resistor R1 is connected to ground, another end of the first resistor R1 is connected to the inverting input terminal of the comparator 108 and an end of the photoconductive cell PU. The second reference voltage is applied to another end of the photoconductive cell PU. The first reference voltage is applied to the non-inverting input terminal of the comparator 108 whose output terminal is connected to the gate of the FET Q1. In the embodiment, when the ambient light intensity decreases, the resistance of the photoelectric cell PU increases accordingly. Therefore, the voltage applied on the photoelectric cell PU increases, while a voltage (which is equal to the first control voltage) applied on the first resistor R1 decreases, so does the first control voltage supplied to the inverting input terminal of the comparator 108. When the ambient light intensity is lower than the predetermined value, the first control voltage is lower than the first reference voltage, thus the comparator 108 outputs a high voltage (the first control signal) which turns on the FET Q1. Thus, an equivalent resistance between the player 50 and the speaker 150 decreases, and almost all current of the analog audio signals flows through the FET Q1 and the speaker 150. When the ambient light intensity is higher than or equal to the predetermined value, the first control voltage is higher than or equal to the first reference voltage, thus the comparator 108 outputs a low voltage or 0 volt (the second control signal) which turns off the FET Q1. The analog audio signals must be transmitted to the speaker 150 via the third resistor R3, and the current of the analog audio signals is limited by the third resistor R3. Thus, the volume of the sound the speaker 150 outputted is higher when the FET Q1 turns on than that when the FET Q1 turns off.

In the above-described portable electronic device 20, the automatic volume adjustor 100 can automatically turn up the volume of the sound the speaker 150 outputted when it determines that the ambient light intensity is lower than the predetermined value. Thus, a call, short message alert, or an alarm clock going off is less likely missed due to a dampening of the alert sound. The portable electronic device 20 also has such advantages as low cost and simplicity.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A portable electronic device, comprising:

a player, for outputting analog audio signals;

a speaker, for transforming the analog audio signals into sound;

a control circuit, for generating a first control signal when ambient light intensity is lower than a predetermined value; and for generating a second control signal when ambient light intensity is higher than or equal to the predetermined value;

a switch circuit, for being turned on and transmitting the analog audio signals to the speaker and decreasing an equivalent resistance between the player and the speaker according to the first control signal; wherein the switch circuit is turned off according to the second control signal; and a current limiter, for transmitting the analog audio signals to the speaker and increasing the equivalent resistance between the player and the speaker when the switch circuit is turned off.

2. The portable electronic device as described in claim 1, wherein the control circuit comprises: a photoelectric circuit, for generating a first control voltage according to the ambient light intensity; the first control voltage is higher than a first reference voltage when the ambient light intensity is lower than the predetermined value;

a comparator, for generating the first control signal when the first control voltage is higher than the first reference voltage, and otherwise generating a second control signal to turn off the switch circuit.

3. The portable electronic device as described in claim 2, wherein the photoelectric circuit comprises a first resistor and a photoconductive cell; a second reference voltage is applied to an end of the first resistor whose other end is connected to a non-inverting input terminal of the comparator and an end of the photoconductive cell; another end of the photoconductive cell is connected to ground.

4. The portable electronic device as described in claim 3, wherein the first reference voltage is applied to an inverting input terminal of the comparator whose output terminal is connected to the switch circuit.

5. The portable electronic device as described in claim 1, wherein the control circuit comprises: a photoelectric circuit, for generating a first control voltage according to the ambient light intensity; the first control voltage is lower than a first reference voltage when the ambient light intensity is lower than the predetermined value;

a comparator, for generating the first control signal when the first control voltage is lower than the first reference voltage, and otherwise generating a second control signal to turn off the switch circuit.

6. The portable electronic device as described in claim 5, wherein the photoelectric circuit comprises a first resistor and a photoconductive cell; an end of the first resistor is connected to ground, another end of the first resistor is connected to an inverting input terminal of the comparator and an end of the photoconductive cell; a second reference voltage is applied to another end of the photoconductive cell.

7. The portable electronic device as described in claim 6, wherein the first reference voltage is applied to a non-inverting input terminal of the comparator whose output terminal is connected to the switch circuit.

8. The portable electronic device as described in claim 1, wherein the switch circuit comprises a transistor.

9. The portable electronic device as described in claim 1, wherein the switch circuit comprises an N-Channel enhancement type field effect transistor, a drain of the field effect transistor is connected to the player, a gate of the field effect transistor is connected to the comparator, and a source of the field effect transistor is connected to the speaker.

10. The portable electronic device as described in claim 9, wherein the switch circuit further comprising a second resistor connected between the gate of the field effect transistor and the ground.

11. The portable electronic device as described in claim 9, further comprising a diode connected between the source and drain of the field effect transistor.

12. The portable electronic device as described in claim 1, wherein the current limiter is a resistor.

13. A portable electronic device, comprising:

a player, for outputting analog audio signals;

a speaker, for transforming the analog audio signals into sound; and an automatic volume adjustor; wherein the automatic volume adjustor transmits the analog audio signals to the speaker and decreases an equivalent resistance between the player and the speaker when ambient light intensity is lower than a predetermined value; the automatic volume adjustor further transmits the analog audio signals to the speaker and increases the equivalent resistance between the player and the speaker when ambient light intensity is higher than or equal to the predetermined value.

14. The portable electronic device as described in claim 13, wherein the automatic volume adjustor comprises: a control circuit, for generating a first control signal when ambient light intensity is lower than the predetermined value;

a switch circuit, for turning on and transmitting the analog audio signals to the speaker when receiving the first control signal;

a current limiter, for transmitting the analog audio signals to the speaker when the switch circuit turns off, and for limiting a current flowing through the speaker.

15. The portable electronic device as described in claim 14, wherein the control circuit comprises: a photoelectric circuit, for generating a first control voltage according to the ambient light intensity; the first control voltage is equal to a first reference voltage when the ambient light intensity is equal to the predetermined value;

a comparator, for generating the first control signal when ambient light intensity is lower than the predetermined value, and otherwise generating a second control signal to turn off the switch circuit.

16. The portable electronic device as described in claim 15, wherein the photoelectric circuit comprises a first resistor and a photoconductive cell; a second reference voltage is applied to an end of the first resistor whose other end is connected to a non-inverting input terminal of the comparator and an end of the photoconductive cell; another end of the photoconductive cell is connected to ground; an inverting input of the comparator is connected to the first reference voltage, an output of the comparator is connected to the switch circuit.

17. The portable electronic device as described in claim 14, wherein the current limiter is a resistor.

18. The portable electronic device as described in claim 13, wherein the switch circuit comprises an N-Channel enhancement type field effect transistor, a drain of the field effect transistor is connected to the player, a gate of the field effect transistor is connected to the comparator, and a source of the field effect transistor is connected to the speaker.

19. The portable electronic device as described in claim 18, wherein the switch circuit further comprising a second resistor connected between the gate of the field effect transistor and the ground.

20. The portable electronic device as described in claim 18, further comprising a diode connected between the source and drain of the field effect transistor.

* * * * *